United States Patent [19]

Berry et al.

[11] 4,139,094

[45] Feb. 13, 1979

[54] CARRIER FOR BOTTLES

[75] Inventors: James W. Berry, Maumee; Samuel C. Markwood, Perrysburg, both of Ohio

[73] Assignee: Owens-Illinois, Inc., Toledo, Ohio

[21] Appl. No.: 794,436

[22] Filed: May 6, 1977

[51] Int. Cl.[2] ..... B65D 75/00

[52] U.S. Cl. ..... 206/158; 206/199; 206/148; 206/519; 220/72

[58] Field of Search ..... 206/148, 149, 151, 519, 206/520, 153, 157, 158, 194, 199; 294/87.2; 220/72

[56] References Cited

U.S. PATENT DOCUMENTS

| | | | |
|---|---|---|---|
| 2,819,557 | 1/1958 | Clark | 206/519 |
| 2,936,070 | 5/1960 | Poupitch | 206/151 |
| 3,084,792 | 4/1963 | Poupitch | 206/151 |
| 3,425,382 | 2/1969 | Johnson | 206/519 |
| 3,752,305 | 8/1973 | Heyne | 206/158 |
| 3,834,750 | 9/1974 | Gauntlett | 206/151 |
| 3,871,699 | 3/1975 | Hatfield | 206/151 |
| 3,884,354 | 5/1975 | Guenther et al. | 206/158 |
| 3,912,075 | 10/1975 | Berry | 206/158 |
| 3,946,862 | 3/1976 | Klygis et al. | 206/158 |

*Primary Examiner*—William Price
*Assistant Examiner*—Joseph Man-fu Moy
*Attorney, Agent, or Firm*—Charles S. Lynch; E. J. Holler

[57] ABSTRACT

A single piece semi-rigid plastic carrier for glass containers is provided with the carrier comprising a planar top panel, which includes gripping means and a plurality of apertures adapted to supportingly receive a plurality of containers for holding same in a multipack assemblage, a generally sinusoidal type peripheral wall extends downwardly from the outer margins of the planar top panel and merges with a peripheral skirt which skirt, in turn, merges with a lip which is generally parallel to the planar top panel. The carrier includes anti-nesting features which allow for the carriers to be easily applied by mechanical equipment over the tops of an array of containers to form the multipack and, in a highly preferred embodiment, the portion of the peripheral wall adjacent the top panel is generally vertically disposed, or substantially perpendicular to the top panel, to provide for additional structural support which will withstand application pressures and prevent buckling of the carrier when applied to the containers.

16 Claims, 9 Drawing Figures

CARRIER FOR BOTTLES

THE INVENTION

The present invention relates to the art of handling bottles and more particularly to the art of forming and handling a multipack of filled containers. Still more particularly the present invention is directed to a carrier for such containers.

Semi-rigid plastic carriers for forming multipacks of bottles or containers such as for example glass containers are known in the art. In this respect reference may be had to U.S. Pat. Nos. 3,752,305, 3,912,075, and 3,871,699 none of which show a carrier, however, in which the uppermost portion of the carrier has a planar top panel. That is, in these patents the carrier shows a plurality of generally annular vertically upright walls extending from a lower horizontal wall which annular upright walls are adapted to receive containers for forming a multipack. As will be appreciated by those skilled in the art these type carriers are not entirely satisfactory since, when one considers that they are fomed by a vacuum or thermoforming process, it is difficult to reliably form the annular upright walls with the desired thickness and hence it is difficult to reliably produce commercially acceptable carriers.

U.S. Pat. Nos. 2,936,070 and 3,084,792 exemplify another type of carrier for multipacks which is recognized in the trade under the name HI-CONE. These type carriers are not of a semi-rigid material as contemplated herein in that they are limp and non-self-supporting. Typically these carriers are manufactured from low density polyethylene and rely on the elasticity and stretchability of such a material to support containers. As will be apparent such type carriers are well adapted for supporting metal cans but because they are not of a semi-rigid plastic they are unsuitable for handling glass containers having a body, an inwardly extending shoulder, and a neck portion unless additional accessories are employed to rigidly support the glass containers in a multipack. U.S. Pat. No. 3,084,792, for example, employs a separate band. Such accessories are not commercially desirable because their employment involves additional costs and is inconvenient. Another patent similarly disclosing the employment of a band to stabilize containers is U.S. Pat. No. 3,946,862.

Other type carriers for containers are exemplified by U.S. Pat. Nos. 3,834,750, 3,884,354, and 2,823,064.

Based on the foregoing it will be appreciated that there is a need in the art for providing a plastic carrier which is a single piece carrier and which is adapted to rigidly support a plurality of glass containers having a neck portion in a multipack configuration and which carrier can be reliably and economically manufactured so as to produce commercially acceptable carriers. Additionally such carrier must be capable of allowing the easy removal of containers therefrom and must be capable of being easily handled in applicating machinery so that the machinery can function with a minimum of downtime when applying such carriers to an array of bottles to form a multipack package.

Applicant has satisfied this need in the art and provides for a single piece semi-rigid plastic carrier, for example one formed from high density polyethylene with a thickness of about 18 to about 25 mils, which carrier per se is adapted to rigidly support a plurality of glass bottles having a neck portion which is disposed inwardly of a body portion and which plastic carrier can be reliably manufactured to produce a commercially acceptable carrier and which carrier is well adapted for reliable, high speed application to an array of bottles to form a multipack. Similarly the multipack package of a plurality of bottles rigidly supported as a unit in the carrier is adapted to allow bottles to be severally and easily removed from the carrier.

Generally the single piece semi-rigid plastic carrier comprises a planar top panel as its uppermost portion and includes: a peripheral wall extending downwardly from the periphery of said panel, said wall having plural outwardly convex arcuate first wall portions and plural outwardly concave second wall portions disposed intermediate the first wall portions and blending therewith to define plural compartments for containers; a ledge extending outwardly from each of the second wall portions; a peripheral skirt depending downwardly and outwardly from the ledges and from the first wall portions; carrier gripping means associated with the panel, with the panel having a plurality of bottle supporting apertures formed therein having plural inwardly extending yieldable tabs adapted to support containers in the compartments and the carrier further including anti-nesting means disposed internally thereof. The anti-nesting means, and especially when a peripheral lip is additionally formed on the carrier, make the carrier outstandingly adapted for use in conventional applicating machinery. Additionally, in a highly preferred embodiment the peripheral wall, including the convex and concave portions, will be provided at the upper margin thereof with a peripheral wall portion which is generally vertical or perpendicular, to the planar top panel. Such an adaptation greatly increases the ability of the carrier to withstand the applicating pressures applied by the applicating machinery and hence greatly eliminates any problems with buckling.

The foregoing and other advantageous features of this invention will become more apparent by reference to the drawings wherein.

Figure 1:
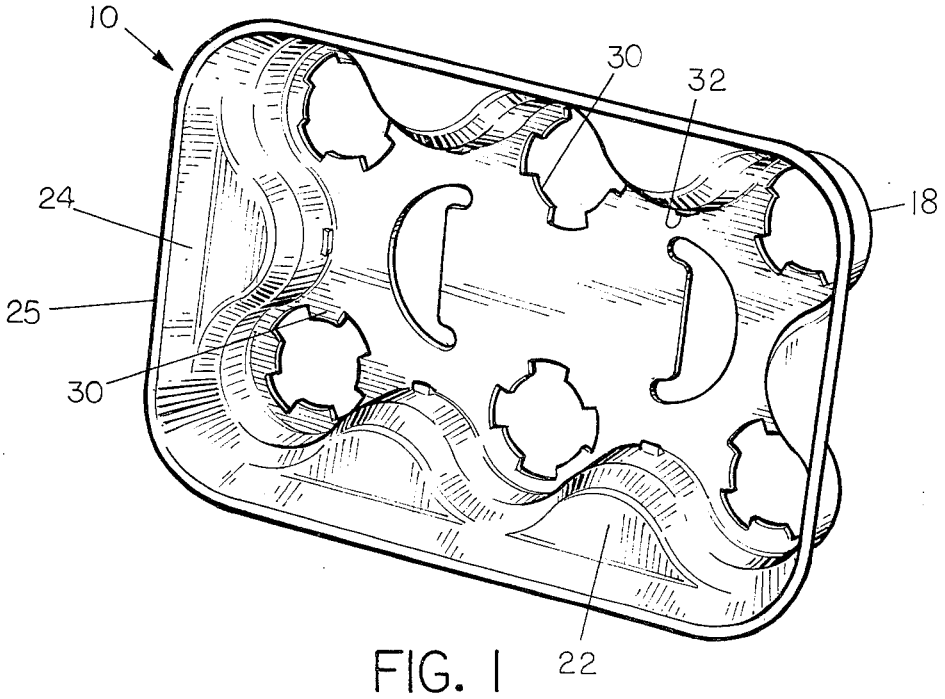
FIG. 1 is a bottom isometric view of the carrier.
Figure 2:
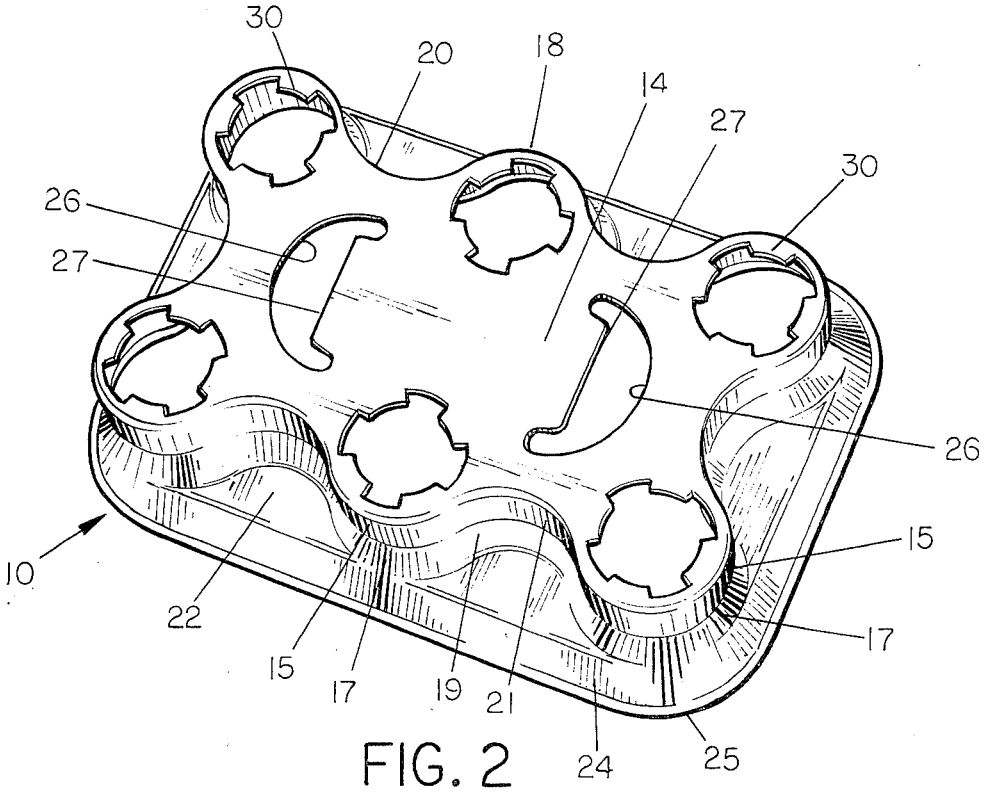
FIG. 2 is a top isometric view of the carrier.
Figure 5:
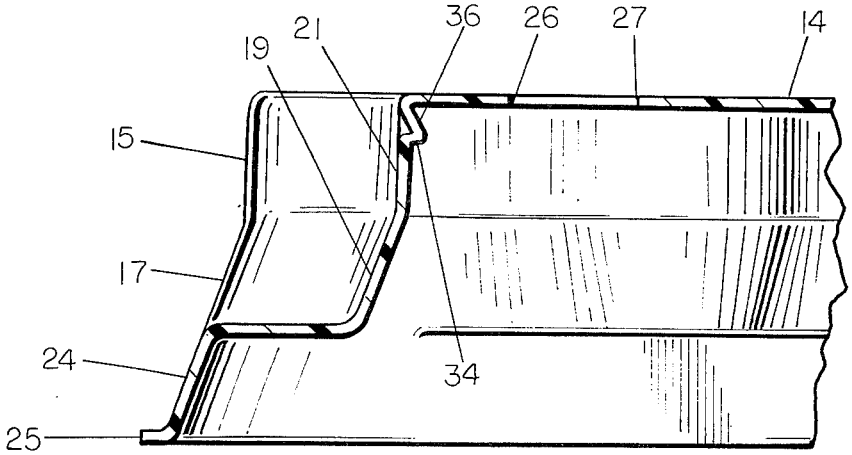
FIG. 5 is an exploded partial sectional view showing preferred anti-nesting means and is generally taken along the line 5—5 of FIG. 7.
Figure 6:
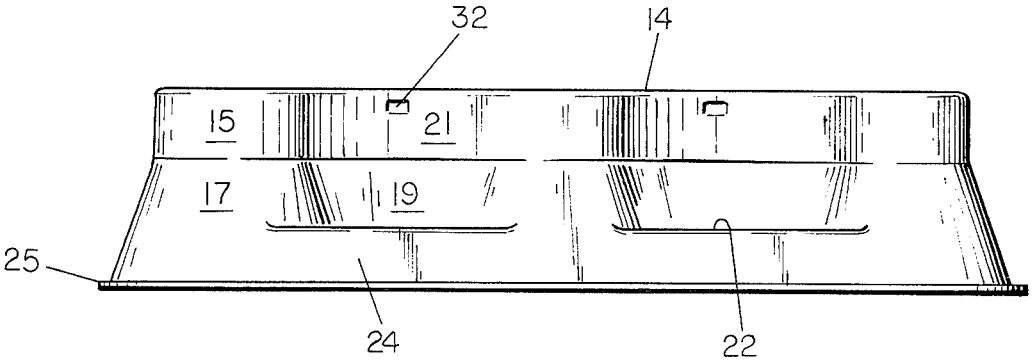
FIG. 6 is a front elevation of the carrier of FIG. 3.
Figure 7:
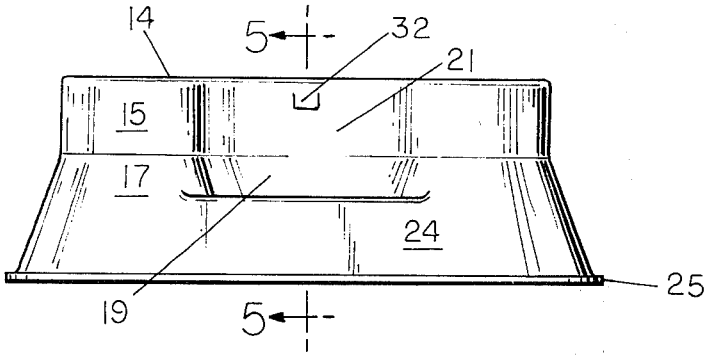
FIG. 7 is a side elevation of the carrier of FIG. 3.

Referring now to the drawings there is shown a single piece semi-rigid, self-supporting, plastic carrier 10 adapted to rigidly support a plurality of containers 12. The plastic of which the carrier is made to provide the semi-rigid characteristics and, as will be subsequently apparent some flexibility or yieldability, is high density polyethylene of a thickness of about 20–25 mils or an equivalent thereof. Carrier 10 generally comprises, as its uppermost portion, a planar top panel 14 and further includes a peripheral wall extending downwardly from and along the periphery of panel 14. The wall is continuous and includes plural outwardly convex arcuate first wall portions 18 and disposed intermediate such first wall portions 18 are a plurality of outwardly concave second wall portions 20 (FIG. 2) which first and second wall portions blend in a continuous manner and define internal plural compartments for containers. Carrier 10 likewise includes a plurality of ledges 22 extending outwardly from each of the second wall portions 20 and a peripheral skirt 24 which depends downwardly from ledges 20 and from the first wall portions 18. Peripheral skirt 24, at its lower margin, merges with a peripheral lip 25 which is generally parallel with planar top panel 14. Associated with panel 14 are carrier gripping means 26 generally in the form of partial circles which include a foldable portion 27 by which the multipack carrier can be easily manually handled. Panel 14 further includes a plurality of bottle supporting apertures formed therein with each of the apertures having plural inwardly extending yieldable tabs 30 adapted to supportingly engage and hold containers 12 such as, for example, a container having a base portion 50, a necked-in or neck portion 52, and a closure 53. Anti-nesting means are disposed internally of carrier 10 and are generally in the form of lug-like projections 32 which are disposed adjacent planar top panel 14 and are integrally formed with the outwardly concave second wall portions 20. Preferably the lug-like projections 32 have a ledge portion 34 generally disposed parallel to panel 14 which ledge-like portion 34 merges with an upwardly and outwardly extending portion 36 (FIG. 5), the latter merging with the carrier adjacent top panel 14.

Preferably outwardly convex arcuate first wall portions 18 include an upper portion with substantially vertically disposed wall sections 15, i.e., wall sections 15 are substantially perpendicular to panel 14, and wall portions 18 include lower portions 17 which merge with the substantially vertically disposed upper portions 15 and extend outwardly and downwardly therefrom generally blending with peripheral skirt 24 at the corners of carrier 10. Similarly the lower margin of outwardly concave wall portions 20 include outwardly and downwardly extending wall sections 19, having substantially the same angle of inclination as the lower portions 17 of wall portions 18, and wherein the outwardly and downwardly extending wall portions 19 terminate at the lower margin with ledge 22 and at their upper margin with substantially vertically disposed wall portions 21.

Figure 3:
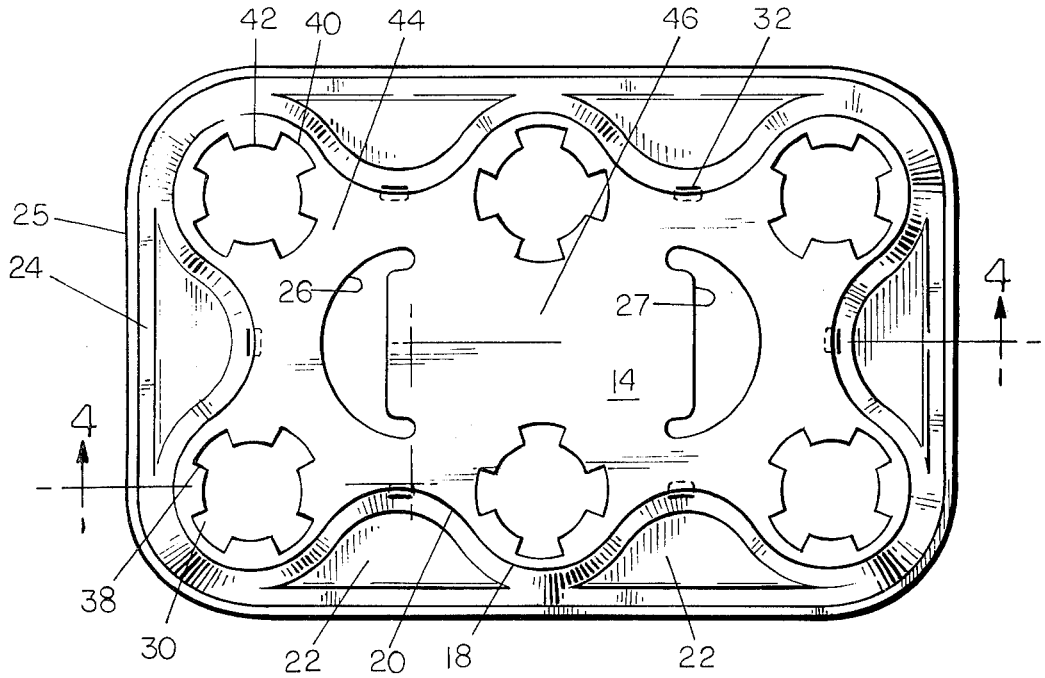
FIG. 3 is a top view of the carrier.
Figure 9:
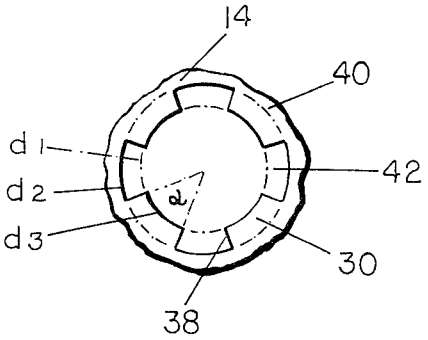
FIG. 9 is a cut-away top view exemplifying a preferred configuration of the bottle supporting apertures of the carrier.

As best exemplified in FIGS. 3 and 9, the apertures for supporting containers 12 comprise a root circle, designated 40, from which plural yieldable tabs 30 extend inwardly and wherein the innermost surfaces of the tabs are arcs of a second circle 42 having a diameter less than the diameter of root circle 40. Suitably each bottle supporting aperture will have 3–8 inwardly extending tabs 30 and extension lines of the sides 38 of tabs 30 will define central angles ($\alpha$) of between about 60° to about 22.5°. Most desirably, however, four such tabs will be employed and the extension lines of the sides 38 will define a central angle of about 45°. Preferably the apertures are so constructed that the distance ($d_1$) between adjacently disposed edges of adjacent tabs 30, along an arc of second circle 42, is less than the length ($d_2$) of the arc of root circle 40 which is disposed between adjacent tabs 30. Additionally the length of arc ($d_2$) of root circle 40, in the portion disposed intermediate adjacent tabs 30, is suitably between about 10% to about 50% larger than the length ($d_3$) of the arc of the inner surfaces of tabs 30, and preferably length ($d_2$) will be between about 28 to 29% larger than $d_3$.

Carrier 10 comprises at least four bottle supporting apertures generally disposed in the corners of the carrier and the apertures comprise a root circle 40 from which yieldable tabs 30 extend; each of the apertures are so arranged and constructed that an extension line (FIG. 3) 44 of a radius of root circle 40 drawn through the center of the arc $d_2$ (that portion disposed intermediate, immediately adjacent tabs 30) intersects at least one axis of the container at an angle of about 45°. Preferably, however, the carrier will be adapted for handling at least 6 containers and hence will include at least 2 additional apertures which are disposed intermediate the corner apertures with these two apertures being so arranged and constructed that extension line 46, of each of these two additional apertures, of a radius of root circle 40 drawn through the center of the arc $d_2$ intersects the same axis at an angle of about 90°.

Figure 8:
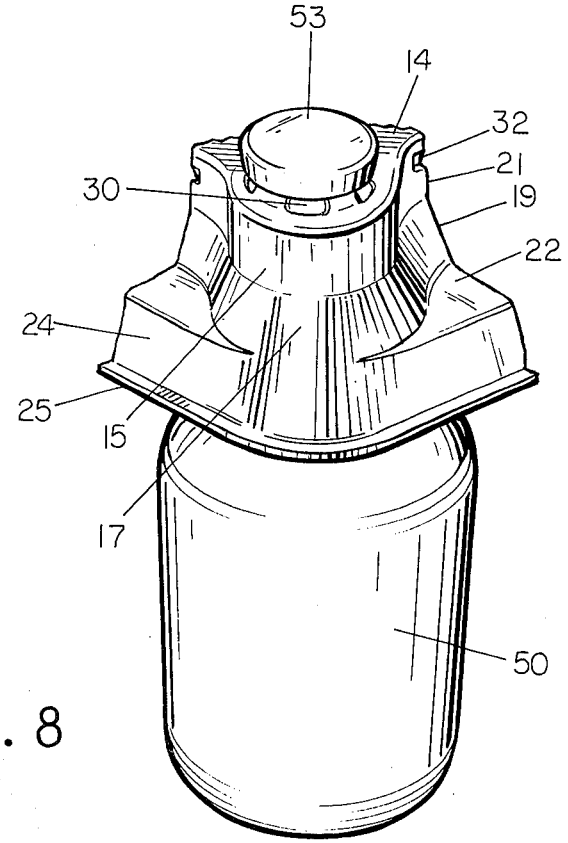
FIG. 8 is an isometric view of a corner portion of the carrier showing the support of a glass container therein.

Thus, as will be readily apparent from the drawings, for example an array of 6 containers are rigidly unitized in a multipack by forcing carrier 10 over cap 53 of containers 12. During this application tabs 30, which initially are substantially coplanar with top panel 14, flex upwardly and because of their semi-rigid characteristics firmly hold the containers 12 by contact with the general undersurface of cap 53. In that position, and as best seen in FIGS. 8 and 4, the tabs then proceed upwardly from planar panel 14.

Figure 4:
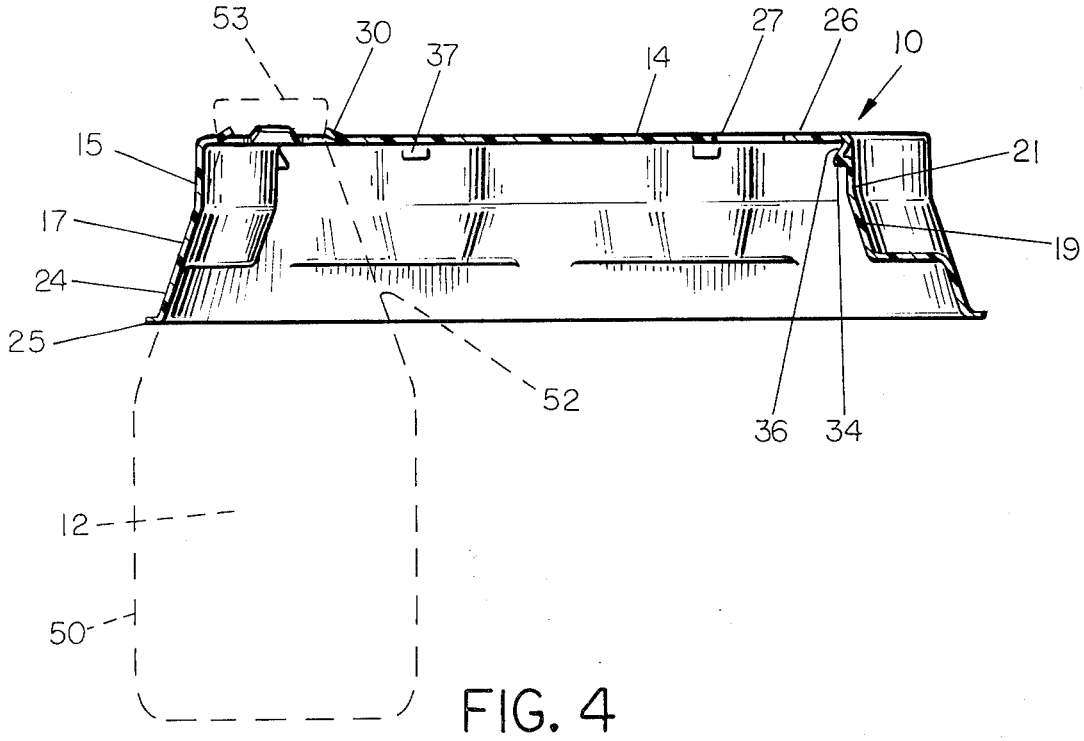
FIG. 4 is a sectional view generally through the line 4—4 of FIG. 3 and exemplifies a supported bottle shown in phantom lines.

Additionally it will be observed, as best seen in FIG. 4, that wall portions 17 snugly engage the exterior surface of bottle 12 to rigidly support the container and, along with similar contact by wall portions 19, prevent lateral movement of the bottles. Vertical wall portions 15 and 21 of the carrier provide for a stronger carrier and help withstand the pressure of the applicating machinery to minimize and preclude buckling during application. As will be readily apparent to those skilled in the art the lug-like anti-nesting projections 36 allow a stack of carriers to be formed and yet leave a gap between respective carriers so that lip 25 can be easily grasped by the applicating machinery for handling and locating the carrier for application to the bottles. Because of this a minimum of downtime is encountered in the application process.

The configuration and orientation of the tabs as described above provide not only for a firm support of the bottles when inserted in the carrier but allow for the easy removal thereof. That is, when, for example employing a carrier for a six-pack as represented in FIG. 3, the tendency for the consumer will be to remove the corner bottles by grasping the lower portion or base portion 50 of the bottle and prying it generally in a direction of about 45° to the longitudinal axis of that carrier. The configuration of the apertures in the corners thus allows for easy removal of the bottle in that manner. Similarly, the tendency of consumers when attempting to remove the centrally disposed bottles will be to generally pry bottles in a direction which is perpendicular to the longitudinal axis. The configuration of these central apertures is such to allow for such easy removal.

Having thus described our invention it will of course be apparent that modifications are possible which pursuant to the patent statutes and laws do not depart from the spirit and scope thereof.

We claim:

1. A single piece semi-rigid plastic carrier for containers comprising:

a planar top panel;

a peripheral wall extending downwardly from the periphery of said panel, said wall having plural outwardly convex arcuate first wall portions and plural outwardly concave second wall portions disposed intermediate said first wall portions and blending therewith to define plural compartments for containers;

a ledge extending outwardly from each of said second wall portions;

a peripheral skirt depending downwardly from said ledges and from said first wall portions;

said outwardly convex arcuate first wall portions including an upper portion with substantially vertically disposed wall portions and lower portions merging with said vertically disposed upper wall portions which extend outwardly and downwardly therefrom and which directly blend with said peripheral skirt at the corners of said carrier;

carrier gripping means associated with said panel;

said planar top panel having a plurality of bottle supporting apertures formed therein, each of said apertures having plural, inwardly extending yieldable tabs disposed in the same plane as said planar top panel and adapted to support containers in compartments and said carrier further including anti-nesting means disposed internally thereof.

2. The carrier of claim 1 wherein said anti-nesting means comprise lug-like projections.

3. The carrier of claim 2 wherein said lug-like projections are disposed adjacent said planar top panel and are integrally formed with said second wall portions.

4. The plastic carrier of claim 1 wherein extension lines of the sides of said tabs define central angles of between about 60° to about 22.5°.

5. The carrier of claim 4 wherein the sides of each of said tabs defines a central angle of about 45°.

6. The carrier of claim 2 wherein each of said bottle supporting apertures has three to eight of said inwardly extending tabs.

7. The carrier of claim 7 wherein the lower margins of each of said outwardly concave second wall portions include outwardly and downwardly extending wall portions generally having the same angle of inclination as said lower outwardly and downwardly extending portions of said first wall portions and wherein said outwardly and downwardly extending wall portions on said second wall each terminate at said ledge.

8. The carrier of claim 1 in which said apertures comprise a root circle from which said plural yieldable tabs extend inwardly and wherein the innermost surfaces of the tabs are arcs of a second circle having a diameter less than the diameter of said root circle.

9. The carrier of claim 8 wherein the distance between adjacently disposed edges of adjacent tabs along an arc of said second circle is less than the length of the arc of said root circle disposed between said adjacent tabs.

10. The carrier of claim 9 wherein the length of the arc of the root circle disposed intermediate adjacent tabs is between about 10% to about 50% larger than the length of the arcs of the inner surfaces of said tabs.

11. The carrier of claim 10 wherein said length is between about 28 to about 29% larger.

12. The carrier of claim 1 wherein said package comprises at least 4 of said apertures and wherein said apertures comprise a root circle from which said yieldable tabs extend inwardly and wherein each of said apertures are so arranged and constructed that an extension line of a radius drawn through the center of the arc of said root circle disposed intermediate immediately adjacent tabs intersects an axis of said carrier at an angle of about 45°.

13. The carrier of claim 12 wherein said 4 apertures comprise the corners of said carrier and wherein said carrier includes at least 2 additional such apertures, said 2 additional apertures being so arranged and constructed that an extension line of each of said two additional apertures of a radius of said root circle drawn through the center of the arc of said root circle disposed intermediate immediately adjacent tabs intersects said same axis at an angle of about 90°.

14. The carrier of claim 13 wherein said anti-nesting means are disposed adjacent the internal surface of said planar top panel and wherein the sides of said yieldable tabs define central angles of about 45°.

15. A container package comprising the plastic carrier of claim 12 and including at least 4 containers therein, each of said containers being disposed within one of said plural compartments and each of said containers being supported at an upper portion thereof by said tabs, said tabs proceeding upwardly from the planar surface of said top panel.

16. The carrier of claim 2 wherein said lug-like projections comprises a lower inwardly extending portion which is disposed generally parallel to said top panel and an upper portion which extends upwardly and outwardly toward said panel.

* * * * *

UNITED STATES PATENT AND TRADEMARK OFFICE

CERTIFICATE OF CORRECTION

PATENT NO. : 4,139,094

DATED : Feb. 13, 1979

INVENTOR(S) : James W. Berry and Samuel C. Markwood

It is certified that error appears in the above-identified patent and that said Letters Patent are hereby corrected as shown below:

Claim 7, line 40, "7" should be --- 1 ---

Signed and Sealed this

*Fifth* Day of *June 1979*

[SEAL]

*Attest:*

RUTH C. MASON
*Attesting Officer*

DONALD W. BANNER
*Commissioner of Patents and Trademarks*